United States Patent [19]

Fletcher et al.

[11] 4,197,172

[45] Apr. 8, 1980

[54] GOLD PLATING COMPOSITION AND METHOD

[75] Inventors: Augustus Fletcher, Bristol; William L. Moriarty, South Meriden, both of Conn.

[73] Assignee: American Chemical & Refining Company Incorporated, Waterbury, Conn.

[21] Appl. No.: 27,364

[22] Filed: Apr. 5, 1979

[51] Int. Cl.[2] ..... C25D 3/62

[52] U.S. Cl. ..... 204/43 G

[58] Field of Search ..... 204/43 G, 46 G, 123; 106/1.13, 1.18, 1.23, 1.26

[56] References Cited

U.S. PATENT DOCUMENTS

| | | | |
|---|---|---|---|
| 3,706,634 | 12/1972 | Kowalski | 204/46 G |
| 3,770,596 | 11/1973 | Bick et al. | 204/43 G |
| 3,856,638 | 12/1974 | Bick et al. | 204/43 G |
| 3,904,493 | 9/1975 | Losi et al. | 204/43 G |
| 4,073,700 | 2/1978 | Weisberg et al. | 204/43 G |
| 4,076,598 | 2/1978 | Lerner et al. | 204/43 G |

*Primary Examiner*—G. L. Kaplan

[57] ABSTRACT

A bath for electroplating hard gold deposits at relatively high current efficiencies comprises an aqueous solution of an alkali metal dihydrogen phosphate, nitrilotris(methylene) triphosphonic acid, a nickel and/or cobalt phosphate compound, triethanolamine borate, alkali metal gold cyanide and a small amount of free alkali metal cyanide. The bath is maintained at a pH of 3.8–4.5 and operated at a current density of 0.1–20 amperes per square decimeter.

11 Claims, No Drawings

GOLD PLATING COMPOSITION AND METHOD

BACKGROUND OF THE INVENTION

Cobalt and nickel are frequently added to gold plating compositions to increase the hardness of the electrodeposited metal; when composition and plating conditions are closely controlled and contamination is minimized, bright deposits are readily obtained over a satisfactory range of current densities. Unfortunately, contamination with various metals frequently occurs and the stability of the bath is affected significantly; moreover, the current efficiency of the bath may be reduced rapidly.

Phosphonic acid chelating agents have long been proposed as components of gold and other metal plating baths to chelate contaminants such as copper and lead. Moreover, it has been recognized that iron contamination can be minimized in baths using a phosphate electrolyte since the phosphate will react with the iron to produce a precipitate.

Exemplary of the baths containing phosphonic acid chelating agents are U.S. Pat. No. 3,770,596 granted Nov. 6, 1973 to Bick et al; U.S. Pat. No. 3,706,634 granted Dec. 19, 1972 to Kowalski; and U.S. Pat. No. 3,904,493 granted Sept. 9, 1975 to Losi et al. Bick et al U.S. Pat. No. 3,856,638 granted Dec. 24, 1974 is of interest in proposing that the nickel and cobalt be reacted with a phosphonic acid compound and aminoguanidine.

The use of various other organic compounds as chelating agents, brighteners, levelling agents and the like has long been known, and the patent and technical literature contain many compounds and combinations of compounds proposed to offer various advantages. Moreover, buffering agents such as citric acid, boric acid, malic acid and the like have also been proposed to control the pH of the bath.

Despite the various known combinations of compounds that might be added to a plating bath for electrodepositing a hard gold alloy, there has remained a continuing problem to provide a stable bath which would operate at high current efficiency in a wide range of current densities and without requiring a change in bath makeup. Moreover, the industry desires all purpose baths which can be used for rack, barrel and high speed plating applications with reasonable efficiency.

It is an object of the present invention to provide a novel gold plating bath which contains cobalt and/or nickel as a hardener, which is stable and efficient over a wide range of current density and which may be used for rack, barrel and high speed applications.

It is also an object to provide such a bath which may be formulated readily and relatively economically and which is highly effective in resisting the effects of copper, lead and iron contamination.

Another object is to provide a novel and highly efficient method for electrodepositing hard, bright gold alloy deposits over a wide range of current densities and in various types of plating applications.

SUMMARY OF THE INVENTION

It has now been found that the foregoing and related objects may be readily attained in a gold plating bath which comprises an aqueous solution containing 15–150 grams per liter of an alkali metal dihydrogen phosphate as an electrolyte and 15–150 grams per liter of nitrilotris(methylene) triphosphonic acid. The bath also includes 3–37.5 grams per liter of triethanolamine borate and a phosphate compound of a metal selected from the group consisting of nickel, cobalt and mixtures thereof, and provides 0.010–5.0 grams per liter of the metal calculated as the metal. Alkali metal gold cyanide is present in an amount providing 2–17 grams per liter of gold calculated as the metal and free alkali metal cyanide is added in an amount equal to at least 2.5 percent by weight of the gold metal and sufficient to prevent precipitation of the metal values. The solution has a pH of 3.8–4.5 and a specific gravity of 6°–22° Baume.

In the preferred compositions, the metal phosphate compound is produced by the reaction of the carbonate salt of a metal selected from the group consisting of nickel, cobalt and mixtures thereof, with nitrilotris(methylene) triphosphonic acid. The preferred metal is cobalt. Optimally, the alkali metal phosphate is present in the amount of 40–60 grams per liter, the triphosphonic acid compound is present in the amount of 40–75 grams per liter, the metal phosphate compound provides the metal in the amount of 0.25–0.5 grams per liter, and the triethanolamine borate is present in the amount of 5–15 grams per liter. The alkali metal gold cyanide provides 7–10 grams per liter of gold metal and the alkali metal cyanide is present in the amount of 3.0–4.0 percent by weight of the gold metal.

In the method of electroplating hard gold deposits upon a workpiece, a workpiece having an electrically conductive surface is immersed in the gold plating bath which is maintained at a temperature of about 30°–60° C. An electrical potential is applied across the workpiece and an anode to provide a current density of about 0.1–20 amperes per square decimeter at the workpiece to effect the desired thickness for the electrodeposit, and the electroplated workpiece is then removed from the bath.

Preferably the current density is 0.5–1.5 amperes per square decimeter.

DETAILED DESCRIPTION OF THE PREFERRED EMBODIMENTS

As previously indicated, the baths of the present invention include an alkali metal dihydrogen phosphate, nitrilotris(methylene) phosphonic acid, a metal brightener, triethanolamine borate, alkali metal gold cyanide and free alkali metal cyanide.

Although any of the alkali metal dihydrogen phosphates may be employed as the primary component of the electrolyte, monopotassium phosphate is preferred. The amount of the phosphate salt may range from as little as 15 to as much as 150 grams per liter with the preferred compositions containing 40–60 grams per liter. The amount required for optimum performance will of course vary with the amounts of the other components. In the present composition, it will be appreciated that the dihydrogen salt serves the dual purpose of providing a part of the electrolyte and of providing buffering of the pH of the bath to maintain it within optimum conditions.

The nitrilotris(methylene) phosphonic acid similarly may vary from as little as 15 to as much as 150 grams per liter with the range of 40–75 grams being preferred. Generally, it is desirable that the amount of the nitrilotris(methylene) phosphonic acid approximate the amount of the phosphate salt in the bath. In the baths of the present invention, the nitrilotris(methylene) phosphonic acid not only serves as a chelating agent but also comprises a part of the electrolyte.

The cobalt and nickel alloying elements to provide the desired hardness in the electrodeposit are provided as phosphate compounds. Although suitable phosphate compounds may be produced by reacting cobalt or nickel carbonate with phosphoric acid, the preferred compounds are produced by reacting the carbonates with nitrilotris(methylene) phosphonic acid in aqueous solution. The product of the reaction is not fully understood, but the product is stable for extended periods of time of a dilute solution is maintained at a pH below about 2.5. The term "phosphate compound" is used herein to encompass the product of reaction of the cobalt and nickel carbonates with either phosphoric acid or nitrilotris(methylene) phosphonic acid. The cobalt and/or nickel phosphate compounds are included in the bath in an amount sufficient to provide 0.010–5.0 grams per liter of the alloying metal(s), and preferably about 0.25–0.5 grams per liter. However, it will be appreciated that the amount of alloying element(s) should be proportional to the amount of the gold with which it is to codeposit.

The method for reacting the metal carbonate with the nitrilotris(methylene) phosphonic acid is relatively simple. To 300 ml. deionized water are added 250 grams of nitrilotris(methylene) phosphonic acid, and the solution is heated to 65° C. There are then slowly added to the solution 50 grams of cobalt carbonate at a rate of about 1.6 grams per minute. The solution is allowed to react until the evolution of carbon dioxide has ended, and then the solution is diluted to 1 liter with deionized water. To provide optimum stability, the pH of the solution should be less than 2.5.

The triethanolamine borate may range from as little as 3.0 grams per liter to as much as 37.5 grams per liter with the preferred range being 5–15 grams per liter. The manner in which this component functions is not fully understood, but it produces a significant benefit in current efficiency, particularly in the low and medium current density areas.

Although the alkali metal gold cyanide may provide as little as 2 grams per liter of gold to as much as 17 grams per liter, the preferred compositions contain the gold metal within the range of 7–10 grams per liter. It has been found essential to include in the composition a small amount of free alkali metal cyanide in order to provide stability, possibly because of a tendency for the other metals to compete for the complexing cyanide ions. The amount of the free alkali metal cyanide should be at least 2.5 percent by weight of the gold metal, and preferably at least 3.0 percent thereof and sufficient to prevent precipitation of the essential metals in the bath. Amounts in excess of about 3.5 percent tend to result in some evolution of hydrogen cyanide gas because of the acidity of the bath and therefor a practical upper limit is 4.0 percent. To ensure optimum stability, the free alkali metal cyanide is desirably added to the alkali metal gold cyanide solution before its admixture with the remaining components.

The pH of the composition is maintained within the range of 3.8–4.5 by reason of the action of the alkali metal dihydrogen phosphate and possibly other components. In actuality, it is found to range from 3.9–4.2 under most conditions of operation and makeup with a pH of 4.0 being optimum.

Depending upon the amounts of the various components, the specific gravity of the bath may vary from 6° to 22° Baume, with the preferred range being 8°–12°. Optimum formulations evidence a specific gravity of about 10°.

As previously indicated, operating conditions using the baths of the present invention may vary fairly widely with temperatures of 30°–60° C. being usable; preferred conditions favor a temperature of 45°–55° C. The current density may vary from 0.1–20 amperes per square decimeter with the preferred combination of optimum deposit and high current efficiency being obtained at 0.5–1.5 amperes per square decimeter.

Various plating apparatus may be employed for the compositions and methods of the present invention including barrel and rack plating equipment, and high speed continuous selective plating equipment. Moreover, in addition to the conventional steady direct current plating, pulse plating can be employed to produce satisfactory deposits at relatively high speed with the least amount of gold content if the metal hardener component is proportionately reduced.

Various anodes may be employed including gold, stainless steel, platinum, platinum-clad tantalum and graphite. The material from which the tank or other vessel is fabricated should be inert to the bath and polypropylene, rubber lined steel, polyvinyldichloride or other suitable materials are desirably employed. The bath should be filtered and agitated during operation to avoid difficulties and to obtain optimum operation.

Exemplary of the efficacy of the present invention are the following specific examples where all parts are parts by weight unless otherwise indicated.

EXAMPLE ONE

A starter bath is prepared having the following composition:

| Component | Amount |
|---|---|
| Monopotassium phosphate | 60 g. |
| Nitrilotris(methylene) phosphonic acid (Sold by Monsanto Company under the designation DEQUEST 2000) | 50 ml |
| Potassium hydroxide | 16 g. |
| Cobalt (as metal) | 0.35 g. |
| Gold (as metal) [introduced as $KAu(CN)_2$] | 8.2 g. |
| Potassium cyanide | 0.24 g. |
| Deionized water | to 1000 ml |

The pH of the composition is found to be 4.0 and the specific gravity is 12° Baume. An aliquot of the composition is modified by adding thereto 7.5 grams per liter of triethanolamine borate.

The two baths are maintained at temperature of 50° C. in a standard Hull cell, and a series of Hull cells panels are plated using a platinized tantalum anode under varying conditions with the conditions and the results observed being set forth below.

| Sample | Amp. | Time, min | Cobalt Conc. | Efficiency | Borate | Bright Range |
|---|---|---|---|---|---|---|
| 1 | 0.5 | 2.0 | 350 ppm | 71.8 mg/AM | No | 0–2 ASD |
| 2 | 0.5 | 2.0 | 350 ppm | 81.4 mg/AM | Yes | 0–1 ASD |
| 3 | 0.5 | 2.0 | 275 ppm | 66.8 mg/AM | No | 0–1.25 ASD |
| 4 | 0.5 | 2.0 | 275 ppm | 77.8 mg/AM | Yes | 0–.75 ASD |

From the data set forth above, it can be seen that the bath containing the triethanolamine borate provides markedly superior current efficiency while still providing a desirable bright plating range.

EXAMPLE TWO

A bath of the formulation of Example One containing the triethanolamine borate is added to a barrel plating apparatus having a barrel with a four inch diameter. Electronic contacts providing a surface area of 1.2 square feet are introduced into the barrel. A current of 3.96 amperes is applied for a period of 5 minutes to provide a current density of 0.33 ASD. Upon completion of the plating operation, the contacts are found to have a hard, bright gold deposit which is highly adherent and free from pitting. The current efficiency is determined to be 60 mg/ampere minute.

From the foregoing detailed specification and examples, it can be seen that the baths of the present invention provide hard, bright gold deposits at relatively high current efficiencies. The bath compositions are able to tolerate reasonable amounts of the conventional metal contaminants and may be readily prepared and replenished. The method of plating using the compositions is simple, is relatively trouble free and is not critical from the standpoint of operating conditions.

Having thus described the invention, we claim:

1. A gold plating bath comprising an aqueous solution of:

A. 15–150 grams per liter of an alkali metal dihydrogen phosphate as the electrolyte;

B. 15–150 grams per liter of nitrilotris(methylene) triphosphonic acid;

C. a phosphate compound of a metal selected from the group consisting of nickel, cobalt and mixtures thereof, said compound providing 0.010–5.0 grams per liter of said metal calculated as the metal;

D. 3–37.5 grams per liter of triethanolamine borate;

E. alkali metal gold cyanide in an amount providing 2–17 grams per liter of gold calculated as the metal; and F. free alkali metal cyanide in an amount equal to at least 2.5 percent by weight of the gold metal and sufficient to prevent precipitation of the metal values, said solution having a pH of 3.8–4.5 and a specific gravity of 6°–22° Baume.

2. The gold plating bath in accordance with claim 1 wherein said phosphate compound is produced by the reaction of the carbonate salt of a metal selected from the group consisting of nickel, cobalt and mixtures thereof, with nitrilotris(methylene) triphosphonic acid.

3. The gold plating bath in accordance with claim 1 wherein said metal is cobalt.

4. The gold plating bath in accordance with claim 1 wherein said alkali metal phosphate is present in the amount of 40–60 grams per liter, said triphosphonic acid compound is present in the amount of 40–75 grams per liter, said metal phosphate compound provides the metal in the amount of 0.25–0.5 grams per liter and said triethanolamine borate is present in the amount of 5–15 grams per liter.

5. The gold plating bath in accordance with claim 4 wherein said alkali metal gold cyanide provides 7–10 grams per liter of gold metal and the alkali metal cyanide is present in the amount of 3.0–4.0 percent by weight of the gold metal.

6. In a method of electroplating hard gold deposits upon a workpiece, the steps comprising:

A. immersing a workpiece having an electrically conductive surface in a gold plating bath comprising an aqueous solution of:

1. 15–150 grams per liter of an alkali metal dihydrogen phosphate as the electrolyte;
2. 15–150 grams per liter of nitrilotris(methylene) triphosphonic acid;
3. a phosphate compound of a metal selected from the group consisting of nickel, cobalt and mixtures thereof, said compound providing 0.010–5.0 grams per liter of said metal calculated as the metal;
4. 3–37.5 grams per liter of triethanolamine borate;
5. alkali metal gold cyanide in an amount providing 2–17 grams per liter of gold calculated as the metal; and
6. free alkali metal cyanide in an amount equal to at least 2.5 percent by weight of the gold metal and sufficient to prevent precipitation of the metal values, said solution having a pH of 3.8–4.5 and a specific gravity of 6°–22° Baume;

B. maintaining the temperature of said bath at about 30°–60° C.;

C. applying an electrical potential across said workpiece and an anode to provide a current density of about 0.1–20 amperes per square decimeter at said workpiece to effect the desired thickness for the electrodeposit; and D. removing the electroplated workpiece from said bath.

7. The method of electroplating in accordance with claim 6 wherein said alkali metal phosphate is present in the amount of 40–60 grams per liter, said triphosphonic acid compound is present in the amount of 40–75 grams per liter, said metal phosphate compound provides the metal in the amount of 0.25–0.5 grams per liter and said triethanolamine borate is present in the amount of 5–15 grams per liter.

8. The method of electroplating in accordance with claim 7 wherein said alkali metal gold cyanide provides 7–10 grams per liter of gold metal and the alkali metal cyanide is present in the amount of 3.0–4.0 percent by weight of the gold metal.

9. The method of electroplating in accordance with claim 8 wherein the current density is 0.5–1.5 amperes per square decimeter.

10. The method in accordance with claim 6 wherein said metal phosphate compound is produced by the reaction of the carbonate salt of a metal selected from the group consisting of nickel, cobalt and mixtures thereof, with nitrilotris(methylene)triphosphonic acid.

11. The method of electroplating in accordance with claim 6 wherein the current density is 0.5–1.5 amperes per square decimeter.

* * * * *